US006533711B1

(12) United States Patent
Anderson et al.

(10) Patent No.: US 6,533,711 B1
(45) Date of Patent: Mar. 18, 2003

(54) RECLOSEABLE POUCH WITH REINFORCED HANDLE AND METHOD OF MAKING SAME

(75) Inventors: Richard F. Anderson, Alpharetta, GA (US); Mark A. Steele, New Prague, MN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/535,610

(22) Filed: Mar. 27, 2000

Related U.S. Application Data

(62) Division of application No. 09/299,541, filed on Apr. 26, 1999, now Pat. No. 6,053,635.

(51) Int. Cl.[7] ..... B31B 1/84

(52) U.S. Cl. ..... 493/213; 493/214; 493/923

(58) Field of Search ..... 493/212, 213, 493/214, 226, 923, 926; 53/133.1, 134.1; 383/10, 17, 20, 63, 104, 122, 906

(56) References Cited

U.S. PATENT DOCUMENTS

| | | | | |
|---|---|---|---|---|
| 2,951,628 | A | | 9/1960 | Grussen |
| 3,554,436 | A | | 1/1971 | Palmer |
| 3,720,141 | A | | 3/1973 | Stock |
| 3,834,113 | A | * | 9/1974 | Howe et al. |
| 3,924,383 | A | | 12/1975 | Heger |
| 4,332,344 | A | | 6/1982 | Strodthoff |
| 4,353,460 | A | | 10/1982 | Kahn |
| 4,484,904 | A | * | 11/1984 | Fowler |
| 4,521,910 | A | | 6/1985 | Keppel et al. |
| 4,696,404 | A | | 9/1987 | Corella |
| 4,795,270 | A | | 1/1989 | Heyden |
| 4,874,257 | A | | 10/1989 | Inagaki |
| 4,913,693 | A | * | 4/1990 | Ball et al. |
| 4,959,114 | A | * | 9/1990 | Mundus |
| 5,045,040 | A | * | 9/1991 | Vetter |
| 5,118,202 | A | | 6/1992 | Bruno |
| 5,184,724 | A | | 2/1993 | Mayled |
| 5,203,758 | A | * | 4/1993 | Achelpohl et al. |
| 5,303,751 | A | * | 4/1994 | Slater et al. |
| 5,354,132 | A | | 10/1994 | Young et al. |
| 5,378,065 | A | * | 1/1995 | Tobolka |
| 5,593,229 | A | | 1/1997 | Warr |
| 5,725,309 | A | | 3/1998 | Robinson |
| 5,863,131 | A | | 1/1999 | Nakamura |
| 5,941,643 | A | * | 8/1999 | Linkiewicz |
| 6,053,635 | A | * | 4/2000 | Anderson et al. |
| 6,209,287 | B1 | * | 4/2001 | Thieman |

FOREIGN PATENT DOCUMENTS

| | | |
|---|---|---|
| WO | WO 89/12006 | 12/1989 |

* cited by examiner

*Primary Examiner*—Eugene Kim
(74) *Attorney, Agent, or Firm*—Alston & Bird LLP

(57) ABSTRACT

A flexible package, and a method of forming such package, which includes two sheets of material joined together at side portions and a bottom portion, with the top edge being open. The top edge is sealed at one portion thereof to provide a reinforced portion, and the remaining portion forms a discharge spout. A handle opening is formed in the reinforced portion, and a fastening strip extends across the entire top edge to provide a openable fastening strip at the spout, and to provide a non-openable portion adjacent the handle opening to provide reinforcement thereat.

5 Claims, 2 Drawing Sheets

RECLOSEABLE POUCH WITH REINFORCED HANDLE AND METHOD OF MAKING SAME

CROSS-REFERENCES TO RELATED APPLICATIONS

This application is a divisional of U.S. patent application Ser. No. 09/299,541 to Richard F. Anderson et al., filed Apr. 26, 1999 now U.S. Pat. No. 6,053,635.

BACKGROUND OF THE INVENTION

This invention relates generally to bags or packages made of flexible material, and more particularly to packages of this type which include a pouch for containing material therein and a selectively openable and closable passageway through which the material can be discharged from the package.

Packages made from flexible mono-layer or multi-layer film, such as polyethylene, nylon or polyester, are made in a wide-variety of forms that are designed to best contain a particular material, and to also permit the material to be easily and conveniently discharged when desired.

In some cases, the nature of the material being packaged make it very desirable to provide the package with a reduced width adjacent the discharge opening of the package so as to provide the package with a spout through which the material can be more easily discharged or poured.

A typical package of this type is disclosed in Tobolka U.S. Pat. No. 5,378,065. However, because conventional package making equipment and methods generally do not make it economically feasible to attach a selectively openable closure device, such as a zipper-type closure strip, across only a portion of the discharge edge of the bag, it has not heretofore been known to make a package with a reduced discharge spout, and a closure strip extending across just the spout portion in the bag.

Additionally, bags which are designed to have spouts frequently contain liquids and other relatively heavy materials, and it is, therefore, desirable to provide the package with a handle so that it can be easily carried.

In general, the easiest and least expensive way to provide a plastic package with a handle is to simply punch an opening through the side walls of the package through which the fingers of the hand can be inserted through the opening to carry the bag. However, punching a hole in the side walls of the package adversely affects the structural integrity of the thin plastic material from which the package is made and this problem is exacerbated when the material contained by the package is relatively heavy.

In accordance with the present invention, a package is provided which is formed with a convenient discharge spout while at the same time having a closure strip for selectively opening and closing the spout, and the package is provided with a reinforced handle portion that is easy to produce and strong enough to permit the package to carry relatively heavy materials.

SUMMARY OF THE INVENTION

The present invention provides a flexible package for containing material, and permitting the material to be discharged therefrom. The package includes two layers or two sheets of flexible material joined together at side portions to form a pouch portion for containing the material, and having one edge portion through which the material can be discharged. A reinforced portion is disposed adjacent the one edge portion at which the two sheets of flexible material are sealed together over a predetermined area, and the reinforced portion is spaced from one of the sealed side portions to provide a material discharge passageway. A handle opening is formed in the reinforced portion, and an elongated fastening strip extends across the two sheets of material adjacent the one edge portion. This elongated fastening strip includes a first portion extending across the material discharge passageway and being selectively openable and closeable to open and close the passageway, and a second non-openable portion extending across the reinforced portion adjacent the handle opening and between the handle opening in the one edge portion to provide additional reinforcement at the handle opening.

In the preferred embodiment of the present invention, the handle opening is provided with a flap of flexible material disposed within the handle opening and attached to one of the flexible sheets by a hinged connection so that the flap is moveable out of the opening about the hinged connection to provide a more comfortable surface for contact with a hand extending through the handle opening. A small breakaway tab may be provided to extend between the flap and an edge of the handle opening to temporarily hold the flap in place.

Also, in the preferred embodiment of the present invention, the two sheets of flexible material are sealed together at two opposite side portions and include a closed bottom side portion, and the one discharge edge extends between the opposed side portions and parallel to the bottom side portion to form the pouch with a generally rectangular shape.

The present invention also provides a method of making a flexible package for containing material, and this method comprises the steps of continuously moving two webs of flexible material along a predetermined path of movement with the two webs being juxtaposed so that the opposite side edges of the moving webs are located adjacent one another, and continuously depositing an elongated selectively openable fastening strip between the two webs in the direction of travel of the web and sealing the fastening strip to one web at a position adjacent one of the side edges thereof. The method also includes joining together the adjacent portions of the two webs along the other of their side edges to provide a closed bottom side of the flexible package, and sealing the two webs together along seal lines located in spaced parallel relation to one another and extending transverse to the path of movement to provide two opposite side portions for the flexible package. The method also includes the step of crushing a portion of the elongated fastening strip extending between the seal lines to cause such portion to be rendered non-openable, and forming a handle opening extending through the two webs at a position adjacent the crushed portion of the fastening strip and between the fastening strip and the closed bottom side of the flexible package.

DESCRIPTION OF THE PREFERRED EMBODIMENT

Figure 1:
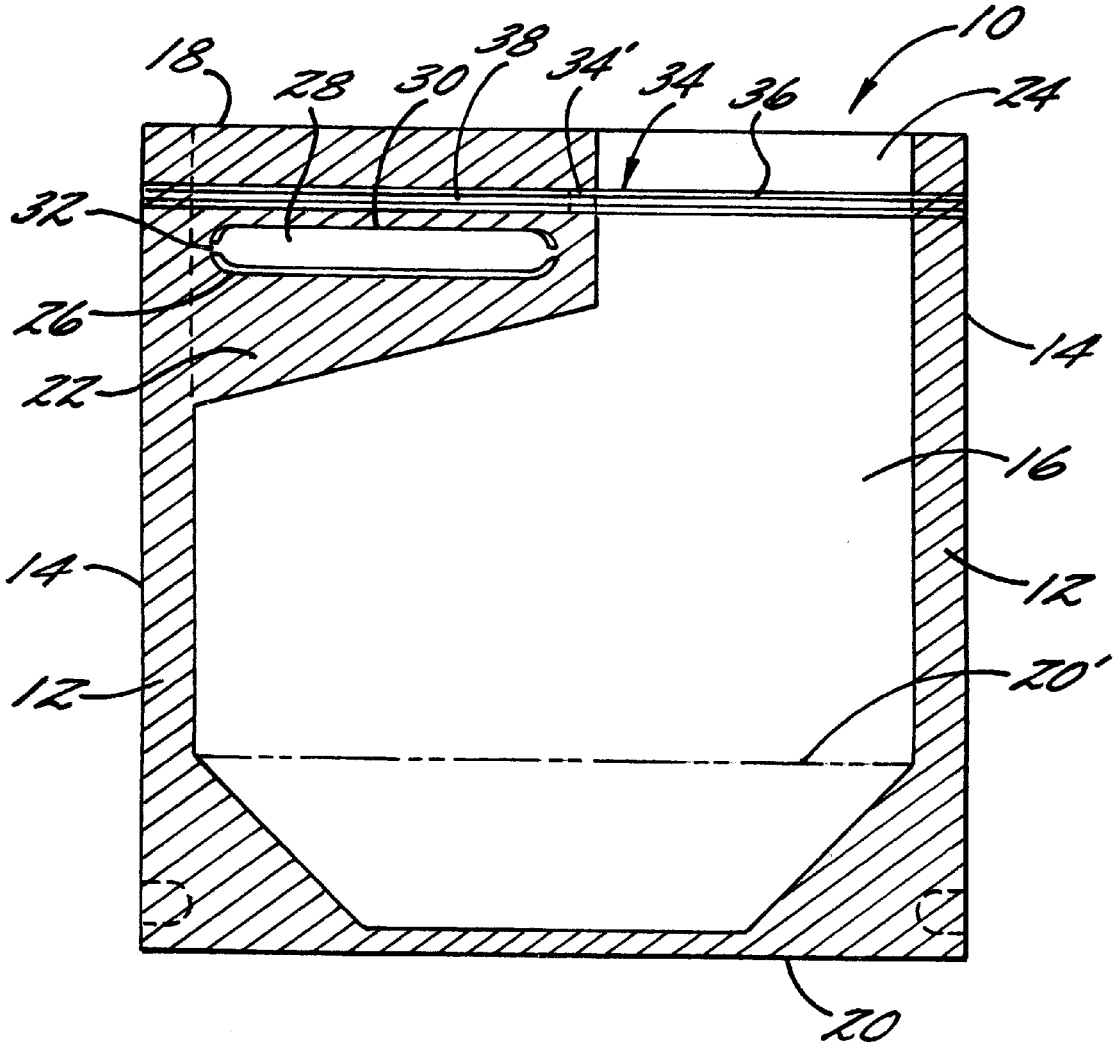
FIG. 1 is a plan view of the flexible package of the present invention.

Looking now in greater detail at the accompanying drawings, FIG. 1 illustrates a flexible package 10 for containing material and permitting the material to be discharged therefrom. The package 10 is constructed of two sheets or layers 12 of flexible material (which could be a single sheet folded upon itself or multiple sheets jointed to one another) joined together at their side portions 14 to form a pouch portion 16 for containing material therein (not shown), and having a top edge portion 18 through which such material can be discharged. It will be understood that in FIG. 1 only one of the two sheets 12 of flexible material is visible, but an identical sheet of flexible material having the identical configuration is disposed behind the visible sheet 12 and is sealed thereto along the side edges 14 and the bottom edge 20 to form the pouch 16 with a generally rectangular configuration. A conventional gusset 20' is formed in the bottom edge 20 so that the bottom surface of the package 10 can flatten out and permit the package to stand up.

The sheets 12 of flexible material are sealed together over a pre-determined area to form a reinforced portion 22 that is disposed adjacent the discharge edge 18, and this reinforced portion 22 is spaced from one of the side edges 14 to provide a material discharge passageway 24 that has a reduced area compared to the pouch 16 to thereby form a spout through which material within the pouch 16 can be readily discharged when the package 10 is tilted so that the discharge passageway or spout 24 is directed downwardly.

A handle opening 26 is formed in the reinforced portion 22, and extends through both sheets 12 of flexible material to permit the package 10 to be carried by inserting the fingers of a hand through the handle opening 26. The handle opening 26 may be punched out of the sheets 12 of flexible material to provide an unobstructed opening, but in the preferred embodiment of the present invention the handle opening 26 has a flap 28 of flexible material disposed within the handle opening 26 and attached to one of the sheets 12 of flexible material at a hinged connection 30 so that the flap 28 is moveable out of the handle opening 26 about the hinged connection 30 to provide a more comfortable surface for contact with the fingers of the hand extending through the handle opening 26. A breakaway tab 32 may be provided to extend between the flap 28 and an edge of the handle opening 26 to temporarily hold the flap in position within the handle opening 26 until the bag is used, and permitting the handle to be moved out of the handle opening 26 by exerting a small force on the flap 28 to tear the breakaway tab 32.

An elongated openable and reclosable fastening strip 34, extends all the way across the two sheets 12 of flexible material adjacent the discharge edge portion 18. In the preferred embodiment of the present invention, the fastening strip 34 is a conventional zipper-type of fastener, but it will be understood that other equivalent openable and reclosable fasteners could be used. The fastening strip 34 includes a first portion 36 that extends across the discharge passageway or spout 24, and this portion is selectively openable and closeable in a conventional manner to open and close the discharge passageway 24. The fastening strip 34 also includes a second portion 38 that extends across the reinforced portion 22 of the package 10 closely adjacent the handle opening 26, and this second portion 38 is disposed between the handle opening 26 and the top edge portion 18. This second portion 38 is formed so that it will not open when the first fastening strip poriton 36 is open to discharge material through the discharge passageway 24. There are many ways in which the second portion 38 can be rendered unopenable, but in the preferred embodiment the fastening strip 34 is simply crushed at a small area 34' thereof which is adjacent to the discharge passageway 24 as illustrated in FIG. 1. The ends of the fastening strip 34, adjacent each side of the package 10, can also be crushed to render them unopenable.

In looking at FIG. 1, it will be noted that the second non-openable portion 38 of the fastening strip 34 extends along the entire length of the handle opening 26 to provide reinforcement of the sheets 12 of flexible material just above the handle opening 26 so that when the package 10 is carried, the load imposed by the weight of material in the bag is borne at the reinforced portion of the package 10 that is provided by the reinforced sealed package portion 22 and the non-openable portion 38 of the fastening strip 34. It will be apparent that maximum reinforcement of the sheets is obtained by using the combination of the reinforced package portion 22 and the non-openable portion 38 of the fastening strip 34, but in some packages 10 the reinforcement provided by the non-openable portion 38 of the fastening strip 34 will be sufficient, and the reinforced package portion 22 can be significantly reduced in size (e.g. just around the periphery of the handle opening 26).

Thus, the flexible package of the present invention is formed with a convenient discharge passageway or spout 24, and this discharge spout is readily openable and closeable selectively by operation of the openable portion 36 of the fastening strip 34. Additionally, the package 10 is provided with a reinforced portion 22 and a non-openable fastening strip portion 38 that makes the bag strong enough to permit the bag to carry relatively heavy materials. By way of example only, the bag could be used to contain live fish that are taken from an aquarium with an appropriate quantity of water to keep the fish alive while it is transported from a retail store to a home aquarium. The discharge passageway or spout 24 permits the water and fish to be easily discharged from the container, and the relatively heavy load imposed on the bag by the weight of the water can be readily carried without tearing or breaking the package 12 because of the reinforcement provided above the handle opening 26. Also, as will be described in greater detail below, the flexible package of the present invention is easy to manufacture because the fastening strip 34 can be continuously applied to the sheets 12 of flexible material as the sheets 12 are moved along a conventional package-forming assembly line. Finally, many conventional packages with handles which are used to contain material that is subject to spoilage must include a seal extending across the top portion of the bag to prevent any migration into the package and a tear-away strip is provided by which this seal can be removed when the contents of the package are to be discharged. In most cases, the handle opening is located above the tear-away strip, and when this strip is removed to unseal the package, the handle is removed as well. In the package 10 of the present invention, a tear-away seal (not shown) can be readily added to the package 10 above the fastening strip 34 after the package 10 has been filled with a material and since the handle opening 26 will remain in place and be fully functional in holding the bag or assisting in discharging material from the bag even after the tear away seal has been removed.

Figure 2:
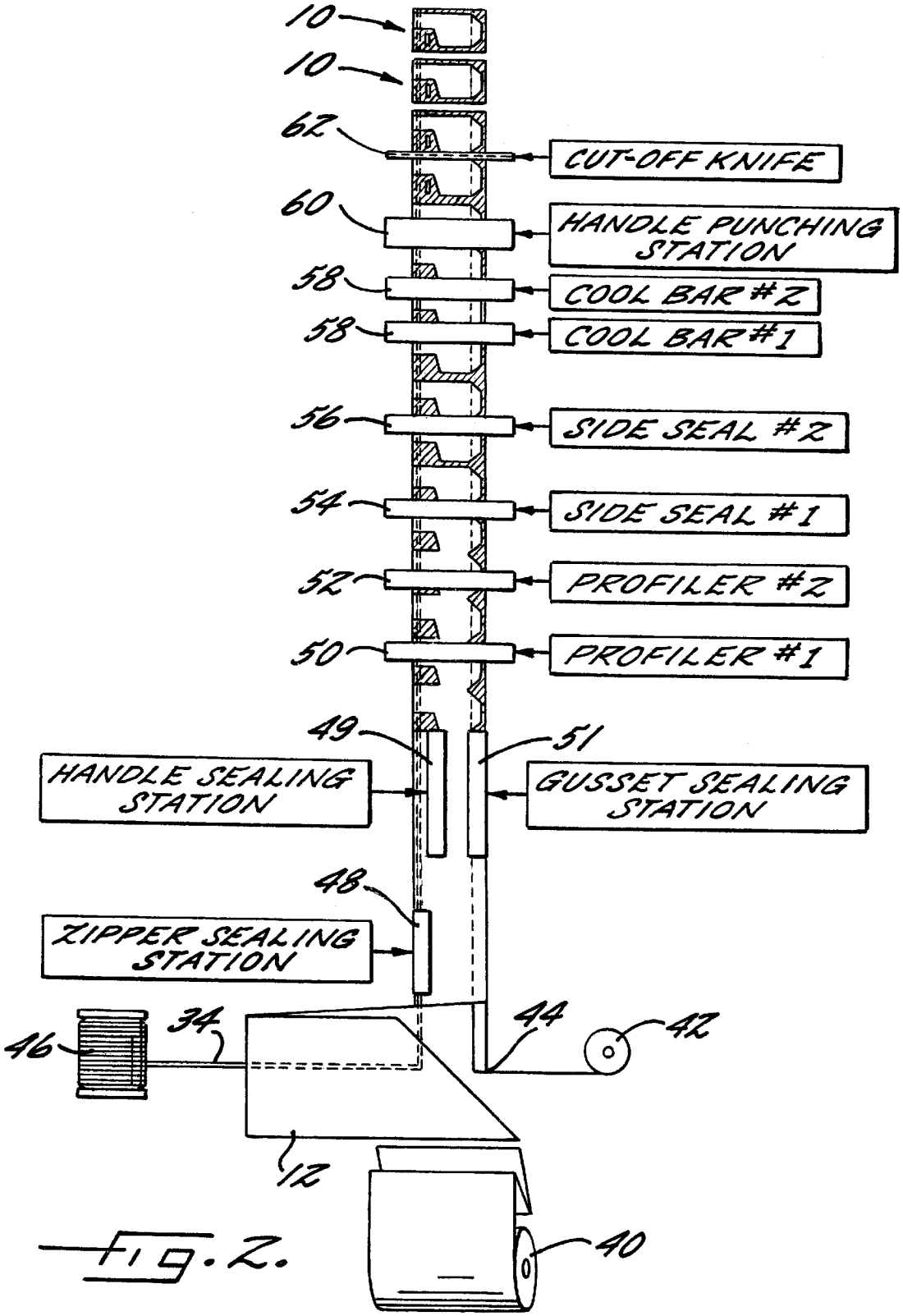
FIG. 2 is a schematic view showing the method by which the flexible package of the present invention is made.

The method of forming the package 10 of the present invention is diagrammatically illustrated in FIG. 2. This process begins with a roll 40 of flexible material, and the flexible material is unwound from the roll and folded over upon itself, in a conventional manner to form two overlapping sheets or layers 12 of material. In the preferred embodiment of the present invention, conventional and well-known equipment is used to unwind a single sheet of flexible material and fold it upon itself as described above and as illustrated in FIG. 2, but it will be understood that the package 10 of the present invention could also be made using other conventional and well-known equipment that joins together two sheets of material from separate rolls of material (not shown), or using conventional and well-known equipment by which a sheet of material is split into two pieces with one being disposed on top of the other.

After the sheets of material are folded, another strip of flexible material is unwound from a second roll 42, and this strip of flexible material passes over a turning bar and folding station 44 at which the flexible strip of material 42 is folded and inserted between the two sheets 12 of flexible material to form the gusset 20 at the bottom of the package 10, all in a well-known and conventional manner. This step can be omitted if the package is not to be a "stand-up" package.

At the same time, a continuous length of the fastening strip 34 is unwound from a roll 46 and is laid between the two sheets 12 of flexible material to extend in the direction of travel of the sheets 12 of flexible material along the top or discharge edges 18 thereof, and the continuously moving webs or sheets 12 of flexible material are moved along a predetermined path of movement with the two webs 12 being juxtaposed so that the opposite side edges of the moving webs 12 are located adjacent one another at the top or discharge edge 18 of the package, and the webs 12 are first conveyed past a conventional fastening strip sealing station 48 at which the fastening strip 34 is sealed to the traveling webs or sheets 12. Next, the traveling webs 12 move past a handle sealing station 49 at which the two webs are sealed together to form the reinforced portion 22 of the package 10, and, at the same time, the gusset strip 42 is sealed to the two sheets of material at the bottom edge thereof at a gusset sealing station 51.

The traveling web then moves past a first profiler station 50 at which the fastening strip 34 is crushed at the small portions thereof which are located adjacent the two side edges of the package 10, and a second profiler station 52 at which the portion 34' of the fastening strip 34 that is located adjacent the discharge passageway 24 of the package 10 is also crushed, thereby rendering both crushed portions of the fastening strip inoperable and unopenable while leaving the first portion 36 of the fastener strip openable and closeable.

Next, the traveling web passes through a first side sealing station 54 which, in a conventional manner, includes a heat seal that initiates the seal along both side edges 14 of the package 10, and a second side sealing station 56 is provided for completing the seal along both side edges 14 of the package 10. The traveling web is then passed under two conventional cooling bars 58, and then to a handle punching station 60 at which the handle opening 26 is formed. Finally, a cutoff knife 62 extends across the traveling web and cuts the traveling web at the sealed side edges 14 to separate the travel web into separate packages 10. In some systems, the reinforced portion 22 and the seals for the gusset strip 42 can be carried out at the profiler stations 50 and 52 and the side sealing station 54, 56, in which case the aforesaid handle sealing stations 49 and gusset sealing station 51 could be used to make a bottom seal rather than forming a gusset.

While all of the equipment used in the method of forming the packages 10 of the present invention is conventional, this equipment is used in a novel manner, as described above, to form a bag that has the discharge passage or spout 24 provided with a first openable fastening strip portion 36, and a reinforced package portion 22 in which the handle opening 26 is formed adjacent to the second non-openable fastening strip portion 38. In the preferred embodiment of the present invention, the handle opening 26 is oblong in shape and extends in a direction generally parallel to the fastening strip 34 as illustrated in FIG. 1, but the handle opening 26 can be formed in a variety of shapes and for a variety of orientations, depending upon the application of the package. Because the fastening strip 24 can be continuously laid onto the traveling web in the direction of travel thereof, as described above, and the portions of the fastening strip 34 which are non-openable can be easily crushed at the two profiler stations 50, 52, all of which provides a relatively easy and quick method of forming the package 10 with all of its attributes and advantages, as described above.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of making a flexible package for containing material and permitting the material to be discharged therefrom, said method comprising the steps of:

a) continuously moving two webs of flexible material along a pre-determined path of movement with said two webs being juxtaposed so that the opposite side edges of said moving webs are located adjacent one another;

b) continuously depositing an elongated selectively openable fastening strip between said two webs in the direction of travel of said web and sealing said fastening strip to said one web at a position adjacent one of said side edges thereof;

c) joining together the adjacent portions of said two webs along the other of said side edges thereof to provide a closed bottom side of said flexible package;

d) sealing said two webs together along seal lines located in spaced parallel relation to one another and extending transverse to said path of movement to provide two opposite side portions for said flexible package;

e) crushing a portion of said elongated fastening strip extending between said seal lines to cause such portion to be rendered non-openable;

f) forming a handle opening extending through said two webs at a position adjacent said crushed portion of said fastening strip and between said fastening strip and said closed bottom side of said flexible package.

2. A method of making a container having a reclosable reduced-width spout for discharging contents of the container therefrom, the method comprising:

forming a pouch out of flexible sheet material such that the pouch has a plurality of closed sides and an open side at which two portions of the sheet material are in overlying relation with each other, the two portions being joined to each other at opposite edges of the pouch;

affixing one member of a two-member reclosable fastener strip to one of the portions of the sheet material and affixing the other member of the fastener strip to the other portion of the sheet material at the open side of the pouch, the fastener strip extending from one side edge to the opposite side edge of the pouch and the members being engageable with each other to close the open side of the pouch; and inseparably sealing the two members of the fastening strip together at a fractional lengthwise portion of the fastener strip such that the two members are permanently inseparable at said fractional lengthwise portion so as to render said fractional lengthwise portion permanently unopenable while the remainder of the fastener strip is openable to create an opening in the pouch having a width less than that defined between the opposite sides edges of the pouch, whereby a reclosable reduced-width spout is provided for the container.

3. The method of claim 2, wherein the step of rendering a fractional lengthwise portion of the fastener strip unopenable comprises crushing a portion of the fastener strip at a location that is to bound one end of the reclosable reduced-width spout, the spout being defined between said crushed portion and one of the side edges of the pouch.

4. The method of claim 3, further comprising the step of sealing the two portions of the sheet material to each other in a region adjacent to the unopenable portion of the fastener strip.

5. The method of claim 4, further comprising forming a handle opening through the pouch in the region at which the two portions of the sheet material are sealed to each other.

* * * * *